US006623412B2

(12) United States Patent
Terranova et al.

(10) Patent No.: US 6,623,412 B2
(45) Date of Patent: Sep. 23, 2003

(54) BAG MAKING MACHINE WITH WEB TENSION CONTROL AND METHOD

(75) Inventors: Peter Terranova, Howard Beach, NY (US); John Simonetti, Deer Park, NY (US); Ed Steiner, Victor, NY (US)

(73) Assignee: Ro-An Industries Corp., Middle Village, NY (US)

( * ) Notice: Subject to any disclaimer, the term of this patent is extended or adjusted under 35 U.S.C. 154(b) by 0 days.

(21) Appl. No.: 09/986,545

(22) Filed: Nov. 5, 2001

(65) Prior Publication Data

US 2002/0077237 A1 Jun. 20, 2002

Related U.S. Application Data

(60) Provisional application No. 60/245,496, filed on Nov. 3, 2000.

(51) Int. Cl.[7] ..... B31B 19/60

(52) U.S. Cl. ..... 493/29; 493/8; 242/418.1; 242/417.1

(58) Field of Search ..... 493/29, 8; 242/418.1, 242/417.1

(56) References Cited

U.S. PATENT DOCUMENTS 3,416,051 A * 12/1968 Pinto et al. ..... 318/6
3,727,859 A * 4/1973 Dobransky et al. ..... 242/331.3
3,807,612 A * 4/1974 Eggert ..... 226/42
4,060,187 A * 11/1977 Grob ..... 226/8
4,070,951 A * 1/1978 Bala ..... 226/113
4,231,560 A * 11/1980 Stohlquist et al. ..... 226/37
4,959,044 A * 9/1990 Smith et al. ..... 493/194
5,094,656 A * 3/1992 Hatchell et al. ..... 226/115
5,230,688 A * 7/1993 Hatchell et al. ..... 493/193
5,298,104 A * 3/1994 Absher ..... 156/351
5,338,281 A * 8/1994 Terranova ..... 493/204
5,733,236 A * 3/1998 De Smedt ..... 493/8
5,735,987 A * 4/1998 Boriani et al. ..... 156/176
5,971,905 A * 10/1999 Fukuda ..... 493/25
6,004,252 A * 12/1999 Blaser ..... 493/186
6,117,058 A * 9/2000 Sauder et al. ..... 493/193
6,164,583 A * 12/2000 Spatafora ..... 242/420.6

* cited by examiner

*Primary Examiner*—Rinaldi I. Rada
*Assistant Examiner*—Brian D Nash
(74) *Attorney, Agent, or Firm*—Steinberg & Raskin, P.C.

(57) ABSTRACT

A bag making machine including a film web supply roll, a draw roll for drawing the film web to a bag forming section, a seal bar in the bag forming section of the bag making machine for sealing the drawn film web, and a tension control system, the tension control system including a surface drive roll, a surface drive roll servo, a vacuum box, a torque mode capstan, a capstan servo drive, a draw roll servo drive, and a controller programable to control the film web tension in a first run of the film web between the supply roll and the torque mode capstan independently from the tension in a second run of the film web between the capstan and the draw roll.

4 Claims, 5 Drawing Sheets

BAG MAKING MACHINE WITH WEB TENSION CONTROL AND METHOD

CROSS-REFERENCE TO RELATED APPLICATION

This application claims priority of U.S. provisional application Serial No. 60/245,496 filed Nov. 3, 2000.

BACKGROUND OF THE INVENTION

Field of Invention

This invention relates generally to "poly" bag making machines and, more particularly, to methods and apparatus for controlling the web tension in such bag making machines.

Poly bag making machines are well known. Generally, draw rolls pull a two-ply web of plastic film material from a supply roll. A transverse cutting and sealing bar (hereinafter referred to as a seal bar) is situated after the draw rolls and is mounted for reciprocation to cut and seal the web after each web index movement to form individual bags. The bags are carried to a stacking station which is situated on a stacker conveyer, by means of a rotating vacuum arm or other assembly. Bag machines of the type described are well known. For example, a typical bag making machine of this type is The Polystar 9000 available from Ro-An Industries Corp. of Maspeth, N.Y., U.S.A.

Generally, bag making machines of the type described are powered by a main drive motor that drives a main drive shaft which in turn drives various components of the bag making machine, including the draw rolls, the seal bar, the vacuum arm assembly and the stacker conveyer. A dancer apparatus is situated between the web supply roll and the draw rolls for adjusting and controlling the tension in the moving web as it is drawn by the draw rolls.

Recently, servo drives have been used to drive various components of bag making machines. For example, a servo motor is used to drive the seal roll in the apparatus disclosed in U.S. Pat. No. 5,230,688 to Hatchell et al. Servo motors are used to drive the draw rolls and stacker conveyer components in a bag making machine disclosed in U.S. Pat. No. 5,338,281 to Terranova. The disclosure of both of these patents is incorporated herein in their entirety.

The poly bag making industry is moving to thinner plastic film material for bags to reduce cost. Thinner plastic film material is more difficult to feed through a bag making machine because a lower web tension must be used than in the case of thicker film material in order to minimize material stretch and/or breakage.

In a typical bag making machine the draw rolls pull the web with an intermittent motion. The web supply roll is too large and heavy to permit such intermittent motion, so a dancer roll apparatus is typically installed between the supply roll and the draw rolls to absorb the intermittent motion. However, the dancer apparatus used in current bag making machines has too much weight and therefore too much inertia to effectively handle thin web materials. Thus, when the draw rolls pull the web, excessive tension is developed in the web in lifting the dancer rolls and in pulling the web from the supply roll through the unwind stand and then through the various parts of the machine. The result with thin film is excessive stretching or breakage.

SUMMARY OF THE NEW INVENTION

An object of the present invention is to provide new and improved web tensioning devices and methods for poly bag making machines.

Another object of the present invention is to provide new and improved web tensioning devices and methods for poly bag making machines especially for use with thin web materials.

Briefly, these and other objects are attained by providing, in lieu of the conventional dancer apparatus, a tension control system including a servo-driven unwind roll for the web supply roll, a vacuum box situated between the web supply roll and the bag machine draw roll which receives a loop of the film web under a partial vacuum, a servo-driven capstan situated at the inlet side of the vacuum box which engages the film web and a servo-driven draw roll. A servo-controller is programmed to control the motion and position of the unwind roll, the capstan and the draw roll, to thereby independently control the tension in a first run of the film web between the supply roll and the capstan and the tension in a second run of the film web between the point of separation from the capstan and the draw roll.

The invention thus eliminates the conventional dancer apparatus and instead utilizes a new tension control system and structure. For convenience, zone 1 is defined as the run of the web extending from the capstan upstream to the supply roll, and zone 2 is defined as the run of the web extending from the point of web separation from the capstan downstream to the draw rolls. In this invention tension control in zone 1 is separate and independent of tension control in zone 2.

This vacuum box is a chamber through which the fast moving web is passed. A partial vacuum draws the web toward the bottom of the chamber, thus forming the web into a dynamic loop which loop becomes deeper or shallower, although its nominal position is about midway of the total box depth. The depth of the loop is varied by varying the speed or power of the vacuum blower or by varying the opening of a bleed valve.

The new system includes a servo driver or amplifier and servo motor to drive a surface drive roll to unwind the supply roll, a servo driver or amp and servo motor to drive the capstan at the intake side of the vacuum box, a servo driver or amp and servo motor to drive the draw roll, and a depth sensor for the web loop in the vacuum box. All these components are in feedback circuitry with a main motion controller, a programmable logic controller and auxiliary motor drive elements.

The system reduces web tension and variations in web tension in three ways:

a. the conventional dancer apparatus with its weight and inertia is eliminated and thus no mechanical parts are accelerated by tension in the web in the run between the vacuum box and the draw rolls;
b. the supply roll is driven by a servo powered surface drive roll so that the web does not have to provide the force to unwind the film material; and
c. the torque mode capstan pulls the web through the unwind stand and machine infeed rollers but does not have to provide the force to move the supply roll.

The torque mode capstan thus defines and separates the two zones of tension within the system. Web tension in the zone 1 run between the supply roll and the torque mode capstan is directly proportional to the torque setting of the servo motor driving the capstan; and the tension in the zone 2 run of the web from the torque mode capstan to the draw rolls is controlled by the level of vacuum supplied by the vacuum blower. All the servos are controlled by an intelligent motion control system.

The new system may be operated to (a) anticipate an interrupt, for example, as when the draw rolls intermittently stop to permit the stacker conveyor to index forward a completed stack, and/or (b) detect an improper web tension situation in zone 1 or 2, or (c) permit an operator or a software program to alter operation parameters. The motion controller then forecasts a new set of servo settings and directs the servo drivers or amplifiers accordingly, which provide feedback leading to consecutive re-settings until the desired operation is achieved.

In the example where the system is programmed to anticipate an interrupt, when the draw rolls stop to permit the stacker conveyor to index forwardly, the supply roll continues to feed web material. The web entering the vacuum box will therefore tend to develop a deeper loop since the web downstream of the box has stopped. To avoid an excessive web back-up in the vacuum box, the loop depth is, just before the interrupt, re-set to be much shallower. Then, upon interrupt, the web entering the vacuum box will cause the shortened loop to extend to a full loop, thereby maintaining the loop in proper form and order. The constant feedback from the loop depth sensor tells the servo powering the surface drive roll to pay out more or less web to keep the loop in the correct position in the vacuum box.

During a forecast and system alteration in the zone 2 web run, as generally described above, the web tension in the zone 1 run is maintained generally constant by the torque mode capstan. Detailed machine sequences are explained below in the description of the preferred embodiments.

BRIEF DESCRIPTION OF THE DRAWINGS

These and other features of the invention will become apparent from the following description taken in conjunction with the preferred embodiments thereof with reference to the accompanying drawings, in which.

DETAILED DESCRIPTION OF THE PREFERRED EMBODIMENT

Figure 1:
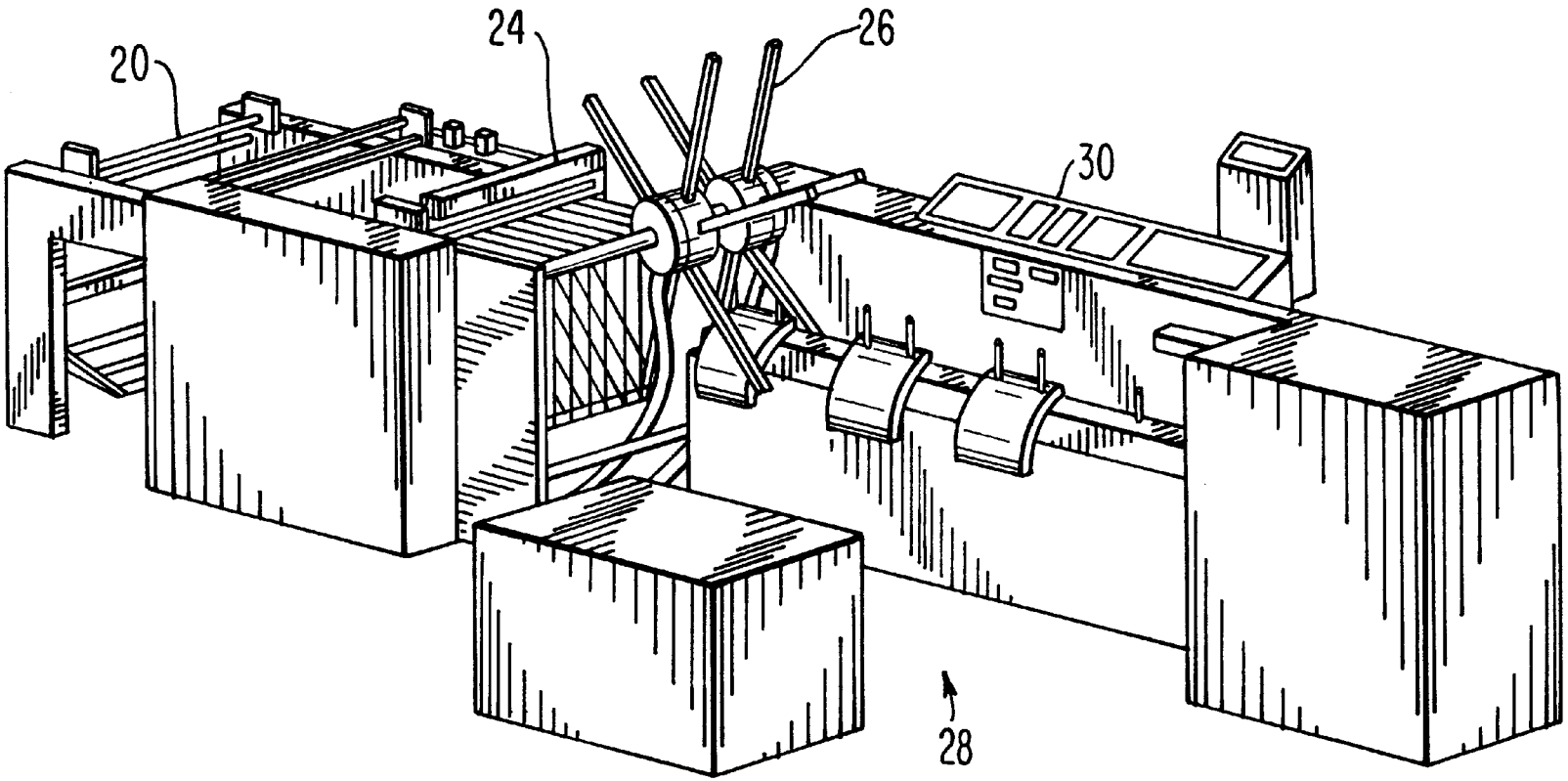
FIG. 1 PRIOR ART
FIG. 1 is a perspective view of a prior art bag making apparatus.
Figure 2:
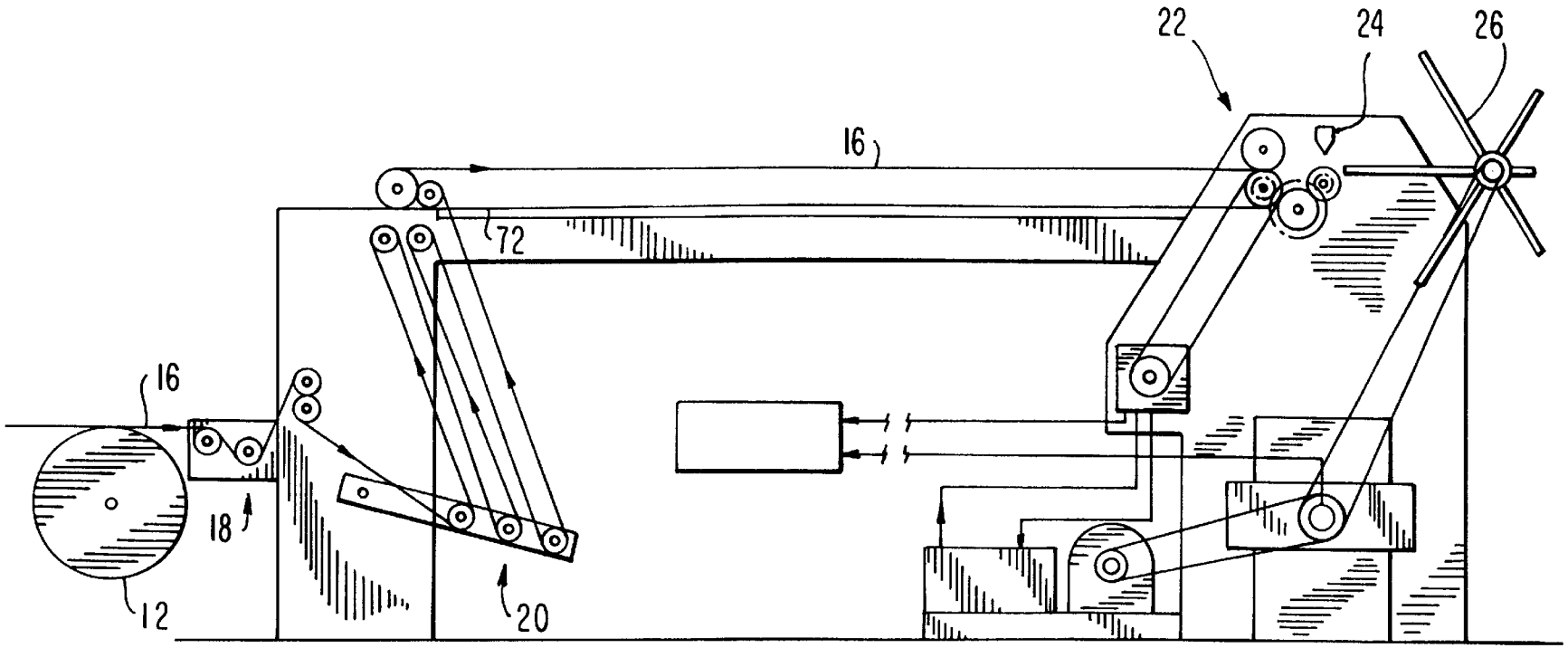
FIG. 2 PRIOR ART
FIG. 2 is a schematic representation of the prior art apparatus of FIG. 1.

Referring now to the drawings wherein like reference characters identify identical or corresponding parts throughout the several views, FIGS. 1 and 2 show components of a common prior art bag making machine 10. At the left side of FIG. 2 is the supply roll 12 for feeding the two ply film web 16 via idler rolls 18 to a dancer or antibounce unit 20 for maintaining appropriate tension in the web between the supply roll 12 and the draw rolls 22. Downstream of these draw rolls is a seal bar 24 followed by a wicketer 26 and finally the bag transfer and stacking section 28.

As is evident, the supply roll 12 and the dancer unit 20 are massive in weight and inertia as compared to the film web 16, and the rapid changes in web motion and web tension caused by intermittent operation of the draw rolls 22 cannot and should not be imposed on the film web upstream of the draw rolls when the film material is thin.

Figure 3:
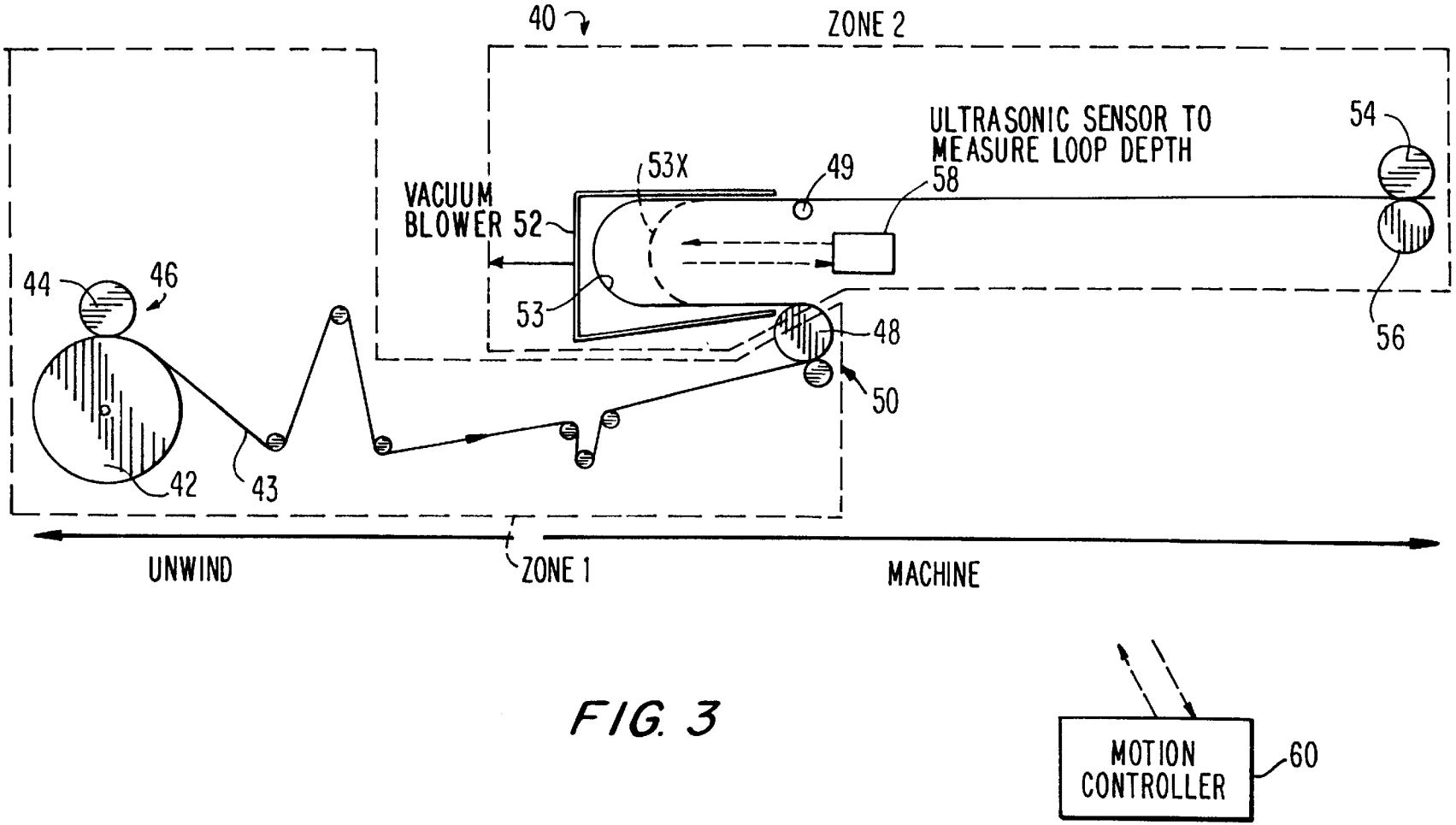
FIG. 3 is a schematic representation of the new invention.

FIG. 3 schematically shows the apparatus of the new invention, generally designated 40, including a web supply roll 42, film web 43, servo driven surface drive roll 44, servo control unit 46 comprising servo motor 46*a* and servo amp 46*b*, servo driven capstan 48 and capstan servo control unit 50 comprising servo motor 50*a* and servo amp 50*b*, vacuum box 52, servo driven draw rolls 54, and servo control unit 56 comprising servo motor 56*a* and servo amp 56*b*, and ultrasonic sensor 58 to measure loop depth in the vacuum box. Thin films may be in the range including but not limited to one half to one and a half mils.

Figure 4:
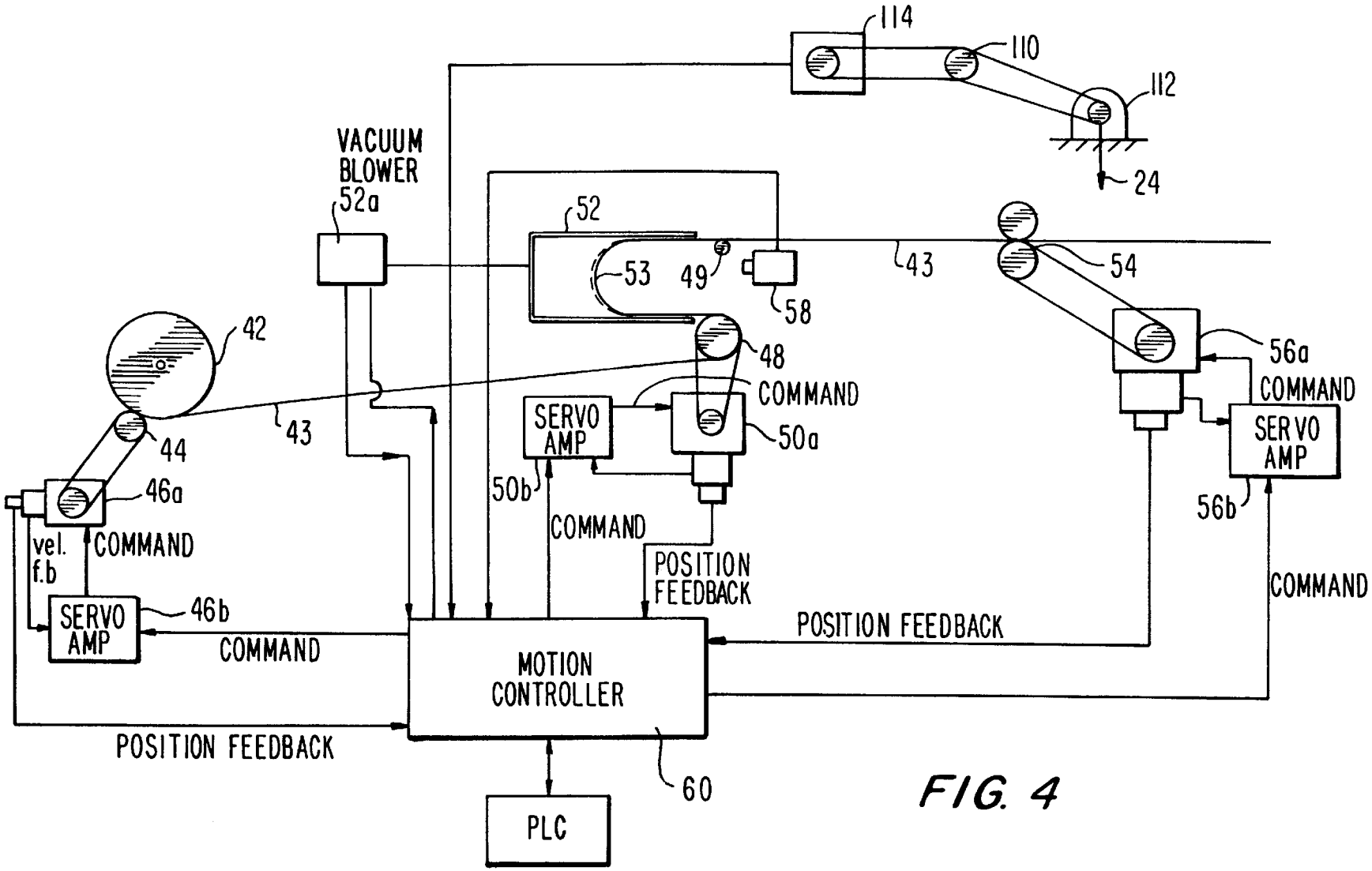
FIGS. 4 and 5 are partial schematic representation diagrams of the servo operation of the new invention.

Referring to FIG. 4, the control elements of each servo motor 46*a*, 50*a* and 56*a* comprise respective tachometers and feedback motor encoders mounted on the servo motors. The seal bar 24 is driven by the main drive shaft 110 which is driven by main drive motor 112. The main shaft 110 drives a master encoder 114 which feeds back the position of the main shaft to the motion controller 60. The motion controller 60 sends respective commands to respective servo amps to energize the respective servo motors to drive the respective components, viz., the surface drive roll 44, the capstan 48 and the draw roll 54. Each servo motor tachometer feeds back the servo motor speed to the servo amp while each encoder feeds back the position of the respective component to the motion controller 60.

The operation of the new bag making machine is as follows.

A. Threading.

To begin an operator manually threads the machine 40 bridging the web 43 across the mouth of the vacuum box 52 from the capstan 48 to the idler roll 49 at the output of the vacuum box. When the control system is activated the torque capstan 48 pulls the web run in zone 1 to desired tension, the vacuum blower 52*a* is started, and then the servo 46*a* is activated to drive the surface drive roller 44 to feed web material from the supply roll 42 until the ultrasonic sensor 58 indicates that the web has formed a loop 53*x* filling about half the depth at position 53*x* (FIG. 3) of the vacuum box 52. Obviously optical, radar or other types of sensors could be substituted for this ultrasonic sensor. Feedback must occur between the main motion controller, supply spool, capstan, ultrasonic sensor and draw rolls to complete this threading operation.

B. Jogging.

The web 43 can be jogged through the machine to perform various setup functions. During the jog operation the torque mode capstan servo motor 50*a*, the vacuum blower 52*a*, and the unwind and the draw roll servo motors 46*a*, 56*a* are activated. The jog speed is set by the rotational speed of the draw rolls 54. A software algorithm predicts the web velocity based on the mechanical components of the machine and the jog speed. The speed of the servo motor 46*a* for the surface draw roll 44 ("The Unwind Speed") is calculated as follows:

Unwind Speed=web velocity+KL*(loop depth setpoint−actual loop depth), where web velocity is calculated from the draw roll speed, and loop depth setpoint is the desired loop position in the vacuum box. The ultrasonic sensor 58 supplies actual loop depth and KL is the gain constant.

During the jog operation the above algorithm is executed repetitively thereby keeping the web loop properly positioned in the vacuum box and properly tensioned. When the jog motion is stopped or the speed is changed the algorithm keeps the loop in control even at zero speed.

The capstan 48 driven by the torque mode drive 48*a*, 48*b* keeps an even pull on the web, changing speed as necessary to keep a constant torque and therefore a substantially constant web tension in zone 1, namely, in the web extending from the supply spool 42 to the capstan 48.

C. Producing Bags.

When the machine is making bags, the web run extending from the draw rolls 54 to the vacuum box 52 is moving intermittently, and the web run extending from the capstan 48 to the supply roll 42 is moving at a nearly constant speed. The software algorithm during the bag making operation is the same as during the jog phase except that the web velocity is predicted based on bag size and machine speed (i.e. a 12 inch bag running at 300 bags per minute requires 300 ft/min of web to be supplied to the machine).

As the machine accelerates to operating speed the predicted web velocity goes from 0 to operational speed. When stopping the predicted web speed goes to 0. There is a software low frequency pass filter on the predicted web speed prediction to minimize the changes of the supply roll speed.

The vacuum box 52 provides the buffer to absorb or supply the web material during draw roll interrupts and other rapid machine speed changes.

D. Additional Vacuum Box Control.

The machine control system changes the setpoint of the desired loop depth in the vacuum box to minimize the change in infeed web speed (supply roll unwind). Small changes in web speed are required when various accessories are added to the process between the supply roll 42 and the vacuum box 52. Two common accessories are often involve cutters or thermal sealers that work best at a constant web speed. Constant web speed also enhances the unwinding of the plastic web from the supply spool.

Before the machine is started into its bag making operation, the loop depth setpoint is moved to provide more loop in the vacuum box. This provides more material in the vacuum box thereby lowering the required acceleration rate of the supply roll. Once the machine reaches operational speed the setpoint is moved back to the nominal position.

In normal operation the machine periodically skips one or more feed cycles for processing of the finished bags. The control system moves the setpoint to a lower depth to reduce the amount of material in the vacuum box. This leaves more capacity for the vacuum box to absorb the material being fed into the machine by the supply roll during the skip cycle. This algorithm minimizes the deceleration rate of the supply spool. Once the skip cycle is completed the setpoint is moved back to its nominal position.

E. Torque Mode Control.

The torque mode servo drive 50*a*, 50*b* operating the capstan 48 is programmed by the machine control system and the machine operator. The torque mode servo drive "torque" setpoint is varied to enhance machine operation. When the web goes from 0 speed to some nominal speed, the "torque" setpoint of the capstan is momentarily increased to accelerate the capstan roller 40 and the various web rollers upstream of the capstan. The over torque amount is calculated based on machine run speed and acceleration rate.

As the machine speed is increased during normal bag making operation, the torque setpoint of the capstan servo drive is increased to compensate for drag on the web. The amount of increase in torque is calculated based on machine speed and operator web tension setting using a programmable non-linear (or linear) algorithm. Various types of materials require different settings.

Figure 5:
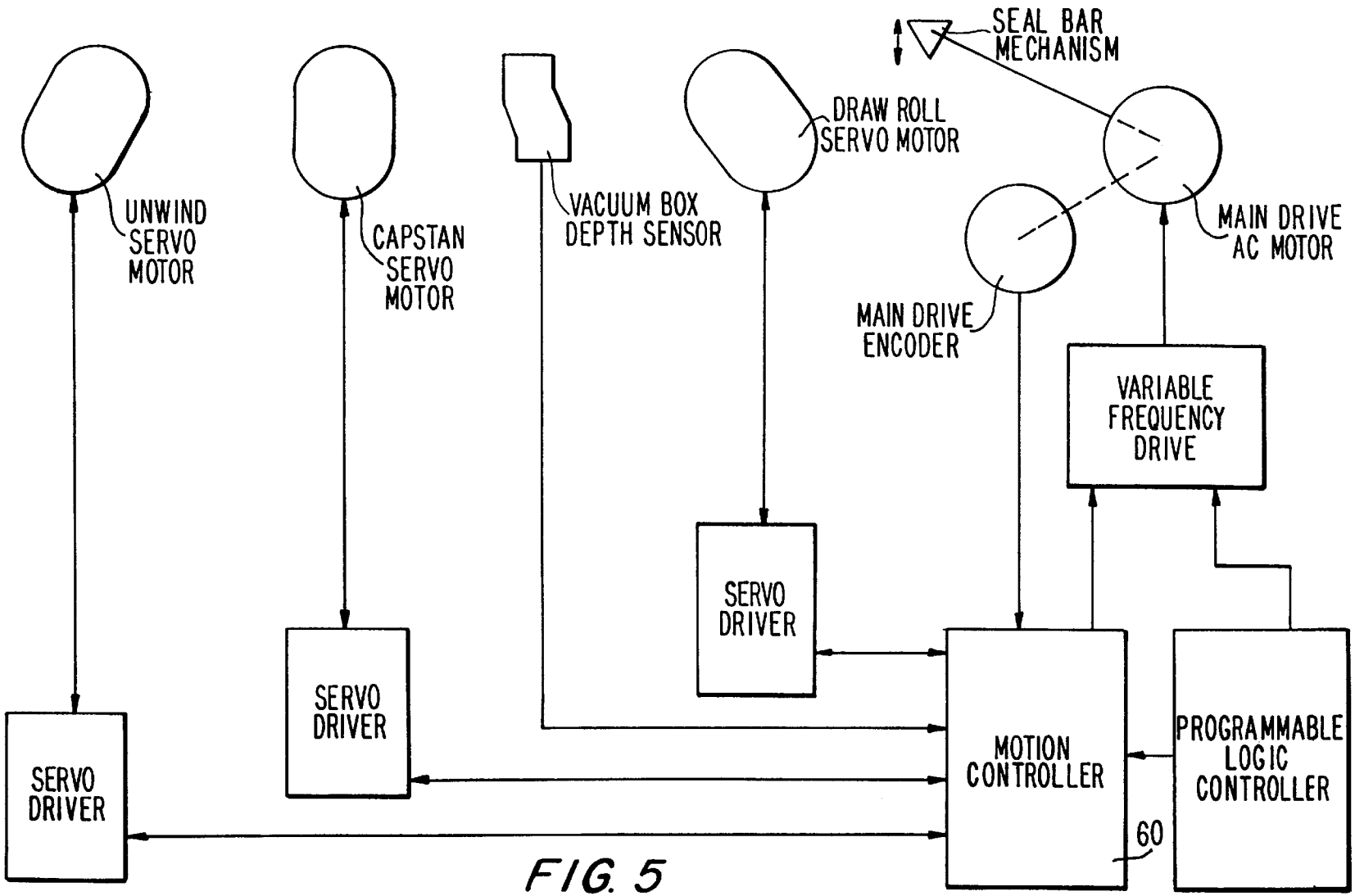

FIG. 5 illustrates schematically the control interrelationships among various servo drivers and the motion controller. As stated earlier and with reference to FIGS. 3 and 4 upstream of the vacuum box 52 is an infeed Zone 1 extending from the supply or unwind drum 42 to the vacuum box. In this zone are usually included accessories such as slitters, folders and gusseters, all of which require relatively high tension in the web for proper operation. To insure the correct tension the capstan servo motor 50 is set to maintain a predetermined level of torque.

A different basis for change in the unwind drum speed would be from direction of the machine operator who desires a different bag-making output and thus produces a forecast of changed operation for each component. At increased output unwind speed must be increased to meet the calculated product of bags per minute×length of each bag, and each component of the system has to be adjusted and coordinated with others for the web to proceed and produce the changed bag output.

Now, attention is directed to the vacuum box 52 and Zone II downstream of the vacuum box. As described earlier, the draw rolls 54 during normal operation stop intermittently when the conveyor/stacker indexes forward a stack of bags. During the interrupt web equivalent in length to about 2–3 bags will be continuously fed by the supply drum and will tend to accumulate immediately upstream of the stopped draw rolls. As is well known, this excess web length is instantly captured by the vacuum box which can accommodate about four bag lengths of web. Since the nominal loop depth of the web in at about the mid point of the vacuum box, the accumulated web length will lengthen the loop to be deeper in the box. This changed condition will be instantly recognized by the ultrasonic loop depth sensor 58 which can easily accommodate the three lengths of bags until the draw rolls returns to their normal rotation.

When the vacuum box pulls in the excess web from the area upstream of the draw rolls, obviously the loop depth will quickly become much deeper which will be recognized by sensor 58 which may take action to avoid overcompensation by directing the vacuum blower to reduce suction or by opening a bleed valve to reduce suction pressure. In any event, the loop depth is a dynamic, constantly changing condition which is constantly monitored by the sensor which averages depth measurements and sends signals to appropriate components to keep the loop depth correct for specific conditions, including resetting the loop depth to its nominal depth for normal operation.

Within the scope of this invention many variations are possible from the preferred embodiments shown herein.

We claim:

1. A bag making machine comprising:

a film web supply roll;

a draw roll for drawing the film web to a bag forming section;

a seal bar in the bag forming section of the bag making machine for sealing the drawn film web; and a tension control system for controlling the tension in the film web between the supply roll and the draw roll, the tension control system comprising:

a surface drive roll for rotating the film web supply roll to pay out film web from the film web supply roll;

a surface drive roll servo drive responsive to signals from a motion controller for controlling the position and rotation of the surface drive roll;

a vacuum box situated between said web supply roll and said draw roll receivable of a loop of the film web under partial vacuum as the film web travels from said web supply roll to said draw roll;

a torque mode capstan situated at an inlet side of said vacuum box engaging the film web and applying tension to the film web supplied from said film web supply roll;

a capstan servo drive having a variable constant torque motor responsive to signals from a controller for controlling the position, rotation and torque of the capstan;

a draw roll servo drive for controlling the position and motion of the draw roll responsive to signals from a controller; and a controller programmable to control the motion and position of said film web supply roll and draw roll and to control the motion, position and torque of said torque made capstan to thereby control the tension in a first run of the film web between said supply roll and said torque mode capstan independently from the tension in a second run of the film web between said torque mode capstan and said draw roll.

2. A bag making machine as in claim 1, further including a vacuum blower coupled to said vacuum box for adjustably modifying the partial vacuum in said vacuum box to control the tension in said second run of said film web.

3. A bag making machine as recited in claim 1 further including a sensor situated at said vacuum box for measuring the depth of the film web loop in said vacuum box.

4. A bag making machine as recited in claim 3 further including a vacuum blower coupled to said vacuum box to control the tension in said second run of said film web, and wherein said sensor and said vacuum blower are coupled to said controller for controlling the motion and position of said supply roll and draw roll and for controlling the motion, position and torque of said torque made capstan.

* * * * *